United States Patent [19]

Jones et al.

[11] Patent Number: 4,835,973

[45] Date of Patent: Jun. 6, 1989

[54] CRYOGENIC REGENERATOR INCLUDING SARANCARBON HEAT CONDUCTION MATRIX

[75] Inventors: Jack A. Jones, Los Angeles; S. Walter Petrick, La Canada; Michael J. Britcliffe, Palmdale, all of Calif.

[73] Assignee: The United States of America as represented by the Administrator of the National Aeronautics and Space Administration, Washington, D.C.

[21] Appl. No.: 140,186

[22] Filed: Dec. 31, 1987

[51] Int. Cl.[4] ..... F25B 9/00

[52] U.S. Cl. ..... 62/6

[58] Field of Search ..... 62/6; 60/520; 55/74; 264/28; 502/183, 402, 429; 165/4, 10

[56] References Cited

U.S. PATENT DOCUMENTS

| | | | |
|---|---|---|---|
| 3,262,277 | 7/1966 | Nesbitt | 62/6 |
| 3,678,992 | 7/1972 | Daniels | 62/6 X |
| 3,793,846 | 2/1974 | Dehne | 62/6 |
| 3,884,830 | 5/1975 | Grant | 502/429 |
| 3,953,360 | 4/1976 | Morishita et al. | 502/402 |
| 3,955,944 | 5/1976 | Grant | 55/74 |
| 4,124,665 | 11/1978 | Petersen et al. | 264/28 |
| 4,259,844 | 4/1981 | Sarcia et al. | 62/6 |

OTHER PUBLICATIONS

Advances in Cryogenic Engineering, vol. 16, pp. 178–184, 1971; "Triple-Expansion Stirling Cycle Refrigerator", by A. Daniels and F. K. du Pre.

Proceedings of the Sixth International Cryogenic Engineering Conference, May 11–14, 1976, "Some Problems of Using Adsorbents as a Matrix Material", edited by K. Mendlessohn.

Alternate Energy Conference; Windsor, Canada, Jun. 1985, "Solid Adsorbents for Storage of CNG for Automotive Use—Saran Carbon", by D. F. Quinn, M. J. B. Evans and J. A. Holland.

High Pressure Adsorption of Methane on Porous Carbons by S. S. Barton et al., p. 65, Fundamentals of Adsorption; A. L. Myer and G. Belfort (editors), Engineering Foundation Press, 345 E. 47th St., New York, New York 10017.

"Extremely Large Heat Capacities Between 4 and 10k", by H. J. Buschow et al., Cryogenics Magazine, May 1975, pp. 261–264.

"An Application of GAP Regenerator/Expandor Precooled by Two Stage G-M Refrigerator", by Y. Matsubara et al., Second Biennial Conference on Refrigeration for Cryogenic Sensors and Electronic Systems, Dec. 7–8, 1982.

"Developments of a 4–5 K Cooling Stirling Cycle Refrigerator", by H. Nakashima, International Cryocooler Conference, Annapolis, Md., 1986.

*Primary Examiner*—Steven E. Warner

*Attorney, Agent, or Firm*—Thomas H. Jones; John R. Manning; Paul F. McCaul

[57] ABSTRACT

A saran carbon matrix is employed to conduct heat through the heat storing volume of a cryogenic regenerator. When helium is adsorbed into the saran carbon matrix, the combination exhibits a volumetric specific heat much higher than previously used lead balls. A helium adsorbed saran regenerator should allow much lower refrigerator temperatures than those practically obtainable with lead based regenerators for regenerator type refrigeration systems.

16 Claims, 4 Drawing Sheets

Fig. 5
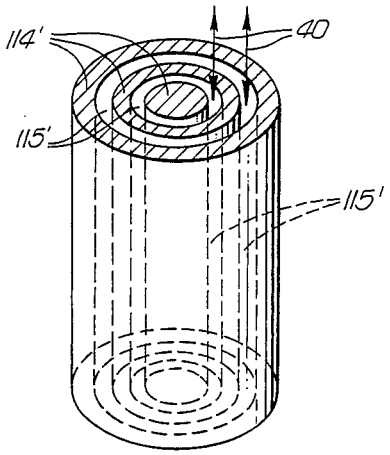
Fig. 6
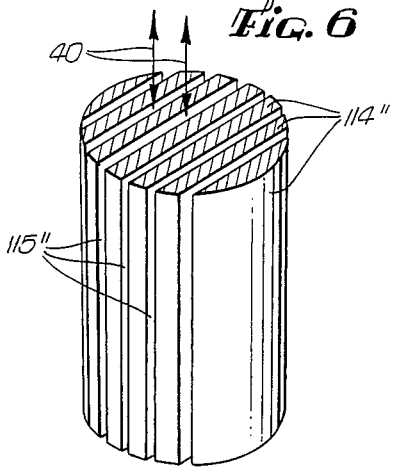
Fig. 7
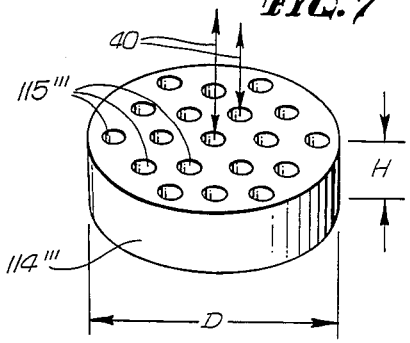
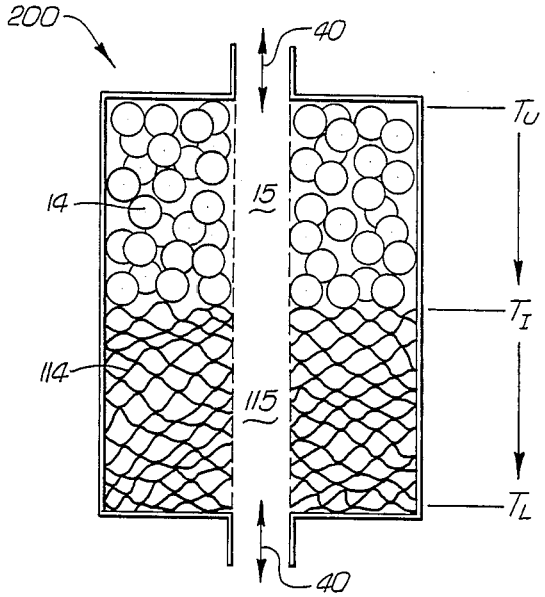
Fig. 8

CRYOGENIC REGENERATOR INCLUDING SARANCARBON HEAT CONDUCTION MATRIX

ORIGIN OF THE INVENTION

The invention described herein was made in the performance of work under a NASA contract and is subject to the provisions of Public Law 96-517 (35 USC 202) in which the Contractor has elected not to retain title.

BACKGROUND OF THE INVENTION

1. Field of the Invention

The present invention is directed to cryogenic refrigeration cycles such as the Stirling and Gifford-McMahon cycles which use a cryogenic heat regenerator. It is more specifically directed to a new class of materials that can be used for storing and discharging heat in a cryogenic regenerator at temperatures below 12 K.

2. Description of the Prior Art

The ideal cryogenic regenerator is a flow-through device which can quickly absorb heat energy from a flowing refrigerant during a first refrigeration cycle, efficiently store the absorbed heat for a length of time, and quickly return the absorbed heat to the refrigerant during another refrigeration cycle. Such an ideal cryogenic refrigerator should be capable of transferring heat energy to and from the refrigerant as quickly as possible and should simultaneously be capable of storing within its volume a substantial portion of the heat energy carried by a corresponding volume of the refrigerant. Numerous attempts have been made to obtain such characteristics at temperatures below 12 K. but the attempts have been at best, only partially successful.

The problems of previously attempted regenerators will be described with reference to FIG. 1 in which there is shown a flow diagram of a known Gifford-McMahon refrigeration system 5 which includes a commonly used cryogenic regenerator 10. The cryogenic regenerator 10 comprises a flow-through chamber 12 filled with a matrix of tiny lead balls 14. The balls 14 are used for absorbing and storing heat from a volume of a flowing-through refrigerant 40. Voids between the balls define a flow-through gap which is schematically indicated at 15. The surface area of the balls 14 determines the heat exchange area of the gap 15. It will be understood that the heat capacity of this regenerator 10 is a function of numerous factors including what percent volume of the chamber 12 is occupied by the lead balls 14 and what mass each ball has. There is a general need within the cryogenic arts to maximize the heat capacity of such a regenerator 10 so that an energy efficient refrigeration system can be constructed.

The chamber 12 is elongated to permit the establishment of a temperature gradient $T_{upper}-T_{lower}$ between respective upper and lower regenerator ports, 16 and 18, disposed at opposed ends of the chamber 12. The upper and lower temperatures, $T_{upper}$ and $T_{lower}$, can vary from system to system, but by in large, the lower temperature $T_{lower}$ has until now been generally limited, for practical applications, to temperatures above 12 K. The importance of this temperature floor will be explained later. It is sufficient for now to state that there has been a long felt desire within the cryogenic field to find an efficient way to lower this temperature floor and that numerous attempts have been made by others to do so.

A displacement chamber 20 having opposed upper and lower displacement ports, 26 and 28, is connected to the corresponding upper and lower ports of the regenerator 10 to form a heat regenerative loop 21 as shown in FIG. 1. The loop 21 includes a lower heat exchanger 23 disposed between the lower regenerator port 18 and the lower displacement port 28. A displacer piston 24 divides the displacement chamber 20 into upper and lower displacement areas, 25 and 27. The displacer piston 24 is driven by a motor 22 which reciprocates the piston 24 upwardly and downwardly to thereby change the volumes of the upper and lower displacement areas, 25 and 27.

A compressor 30, incorporating a reciprocal piston 31 that is designed to compress a cryogenic refrigerant 40 such as helium, is coupled to the regenerative loop 21 through a pair of conduits and a series of electrically controlled valves 32A, 32B, 32C and 32D. An upper heat exchanger 33 is interposed in a first of the conduits between the compressor 30 and the regenerative loop 21.

The operation of the illustrated refrigeration system 5 will now be explained. Valves 32A–32D are initially closed. Input power $W_{in}$ is applied to the compressor 30 to compress the refrigerant 40. Compression causes the temperature of the refrigerant to rise above an output temperature level $T_{out}$ existing at the upper heat exchanger 33. Valves 32A and 32B are opened. The heated refrigerant 40 flows through the upper heat exchanger 33 where it releases a certain amount of output heat energy $Q_{out}$ at the output temperature level $T_{out}$. At the same time, the displacer motor 22 is actuated to move the displacer piston 24 downwardly so that the refrigerant 40, which has just been cooled to the output temperature level $T_{out}$ in the upper heat exchanger 33, enters the upper displacement area 25.

Valves 32A–32D are closed. The displacer piston 24 is then moved upwardly to force the refrigerant 40 in the upper displacement area 25 to flow clockwise through the illustrated regenerative loop 21. The refrigerant 40 is forced through the regenerator 10 and the lower heat exchanger 23 into the lower displacement area 27 of the displacement chamber. The lead balls 14 of the regenerator are precooled to temperatures in a range $T_{upper}-T_{lower}$ below $T_{out}$ so that the lead balls can absorb a first amount of heat energy $Q_1$ from the refrigerant as it flows through in the clockwise direction. By the time it exits the lower regenerator port 18, the refrigerant 40 should be cooled to approximately the lower temperature $T_{lower}$ of the regenerator 10. The cooled refrigerant is temporarily held in the lower displacment area 27.

Valves 32C and 32D are next opened and the compressor piston 31 is moved upwardly to reduce pressure in the loop 21. As a result of this pressure reduction, the temperature of the refrigerant in the lower displacement area 27 drops a second time, to a new temperature below the initial lower temperature $T_{lower}$ of the regenerator. The displacement piston 24 is reciprocated downwardly and the twice cooled refrigerant within the lower displacement area 27 is then forced back through the lower heat exchanger 23 and upwardly through the regenerator 10 into the compressor 30. As the refrigerant 40 passes upwardly through each of the lower heat exchanger 23 and regenerator 10 it absorbs respective amounts of heat energy $Q_{in}$ and $Q_2$from each these loop components. The corresponding temperatures of the lower heat exchanger, $T_{in}$, and the lower temperature, $T_{lower}$, of the regenerator are reduced by this heat absorbing step.

In a subsequent cycle, the reduced lower temperature $T_{lower}$ of the regenerator 10 is used to further cool the refrigerant when the refrigerant 40 again moves from the upper displacement area 25 in a clockwise direction through the loop 21 into the lower displacement area 27. The refrigerant 40 becomes cooler and cooler with each successive cycle until physical limits of heat exchange between the refrigerant flowing through the regenerator and the heat absorbing/discharging material (lead balls 14) of the regenerator 10 are reached.

For prior art regenerators which use a lead ball matrix 14 this temperature limit occurs at approximately 12 degrees Kelvin. Some devices have been built which reduce the temperature floor to 10 K. or less but only with a substantial loss of operating effeciency ($W_{in}$ versus $Q_{in}$). The temperature floor is believed to result primarily from the fact that the volumetric specific heat of lead (Pb) drops below that of a pressurized refrigerant composed of free flowing helium at approximately 12 K. (FIG. 2). Numerous attempts have been made to use materials having volumetric specific heats larger than that of lead but these attempts have created other problems. The higher heat capacity obtained from previously tested materials has been offset by heat conduction characteristics inferior to those of lead (Pb). The previously tested materials include thallous and cerium-halide materials, gadolinium compounds, neodymium and europium-sulfide materials, microspherical silica gel, ultra fine lead particles and even ordinary charcoal.

One reason why there is a desire to develop a regenerator which can operate efficiently below 12 K. will now be explained. In various cryogenic applications, such as the cooling of infrared detectors aboard an orbital platform (space satellite), cooling to temperatures very close to absolute zero (i.e. 4 K.) is required for the infrared detectors to operate at a desired sensitivity level. Previously, a secondary refrigeration cycle employing a gas expansion device known as a Joule-Thomson valve was used to reach temperature levels below 12 K. Known Stirling-type refrigeration systems were incapable of reaching such temperatures in an efficient manner.

The Joule-Thomson valve relies on a very tiny orifice which is used for the expansion cooling of helium to temperatures as low as 2 K. The orifice is prone to clogging by contaminants such as trace particles of lubricating oils that may enter the refrigerant carrying conduits of a J-T system. Orifice clogging is believed to be a primary factor responsible for a known propensity of J-T refrigeration systems to malfunction. A solution to this clogging problem has not yet been found.

Helium J-T refrigerators have a mean time between maintenance (MTBM) of roughly 2,000 hours. This MTBM makes the J-T systems impractical for cooling remotely located sensing devices such as those placed aboard an orbiting satellite. In contrast, the Gifford-McMahon and Stirling type refrigeration systems, which do not rely on a tiny orifice, can be built to have MTBM's on the order of approximately 20,000 hours or better. The present invention makes possible a refrigeration system that can operate efficiently and attain both a relatively high MTBM and a temperature below 12 K. Heretofore, the efficient range of operation of such higher MTBM systems was generally limited to temperatures above 12 K.

SUMMARY OF THE INVENTION

In the last few years, a new class of gas-absorbing carbonicious materials has been developed. The materials exhibit a BET surface-area/mass ratio of approximately 1000 meters$^2$/gram or better, a volumetric density of approximately 0.5 gram per cubic centimeter or better, and a relatively good rate of heat conduction, exceeding at least that of gaseous helium. These materials are being referred to by the first group to produce them as saran-carbon or saran-charcoal because the materials were made from a saran* polymer. (*Saran is a trademark of the Dow Chemical Company).

The saran-carbon type of materials can be produced by the pyrolysis of polymeric organic compounds in either a vacuum or an inert atmosphere. The pyrolysis environment absorbs non-carbon constituants and leaves behind a porous skeletal structure composed chiefly of carbon. The skeletal structure can be characterized as a solid carbon matrix of a substantially continuous nature that has a relatively high percentage by volume of very small pores of diameters on the order of approximately 3 nanometers or less (micropores). Saran carbon materials have been used thus far for storing methane gas.

In accordance with the present invention, a saran-carbon type of material is to be used as a heat conduction matrix for transferring heat to and from an absorbed heat storage medium, i.e. an absorbed mass of helium. Preferably, the saran carbon matrix should be of the "Dacey" type ("D" type) which is continuous over linear distances of at least 0.5 cm. More preferably, continuity should be maintained over distances of 1.0 cm or greater. Furthermore, the pore size of such a saran carbon matrix is preferably optimized to be in the range of less than 3 nanometers but greater than 1 nanometer.

The volumetric specific heat of a helium mass stored in the micropore volume of a saran carbon matrix has been calculated to be substantially greater than that of lead. The heat conductivity characteristics of such a helium sorbed matrix are expected to be substantially superior to those of a helium mass alone. As such, the temperature limit of cryogenic regenerators can be reduced to well below 12 K. so that Stirling and Gifford-McMahon types of refrigeration systems using such regenerators can be efficiently operated at temperatures as low as 4 K., for example.

BRIEF DESCRIPTION OF THE DRAWINGS

FIGS. 5–7 illustrate various embodiments in accordance with the present invention.

FIG. 8 illustrates a composite regenerator which includes both saran carbon and lead.

DETAILED DESCRIPTION

In order for a regenerator to operate efficiently within a cryogenic refrigeration cycle, the heat absorbing/discharging material of the regenerator should have a large heat capacity.

Figure 1:
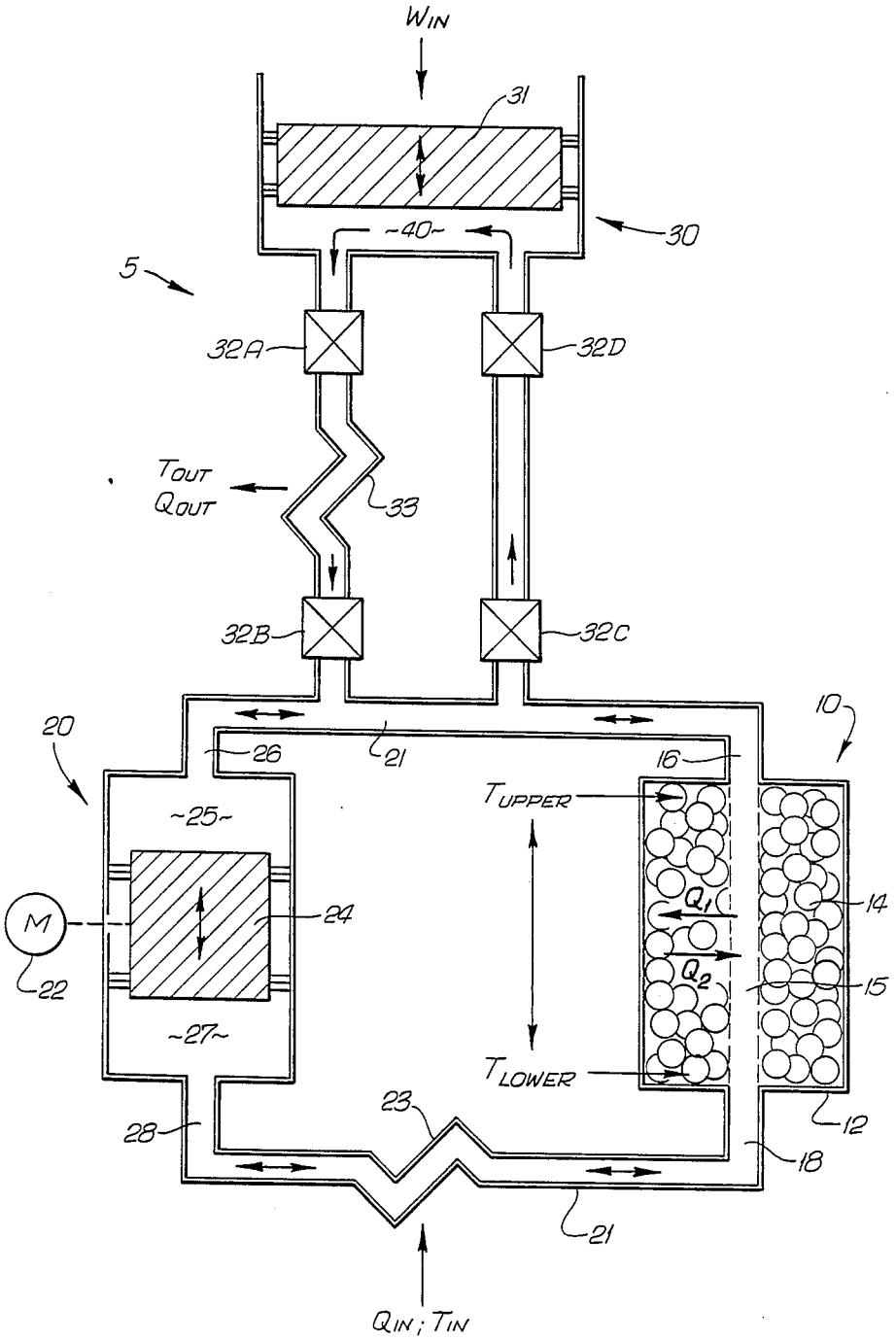
FIG. 1 PRIOR ART
FIG. 1 is a flow diagram of a previously known Gifford-McMahon refrigeration system.
Figure 2:
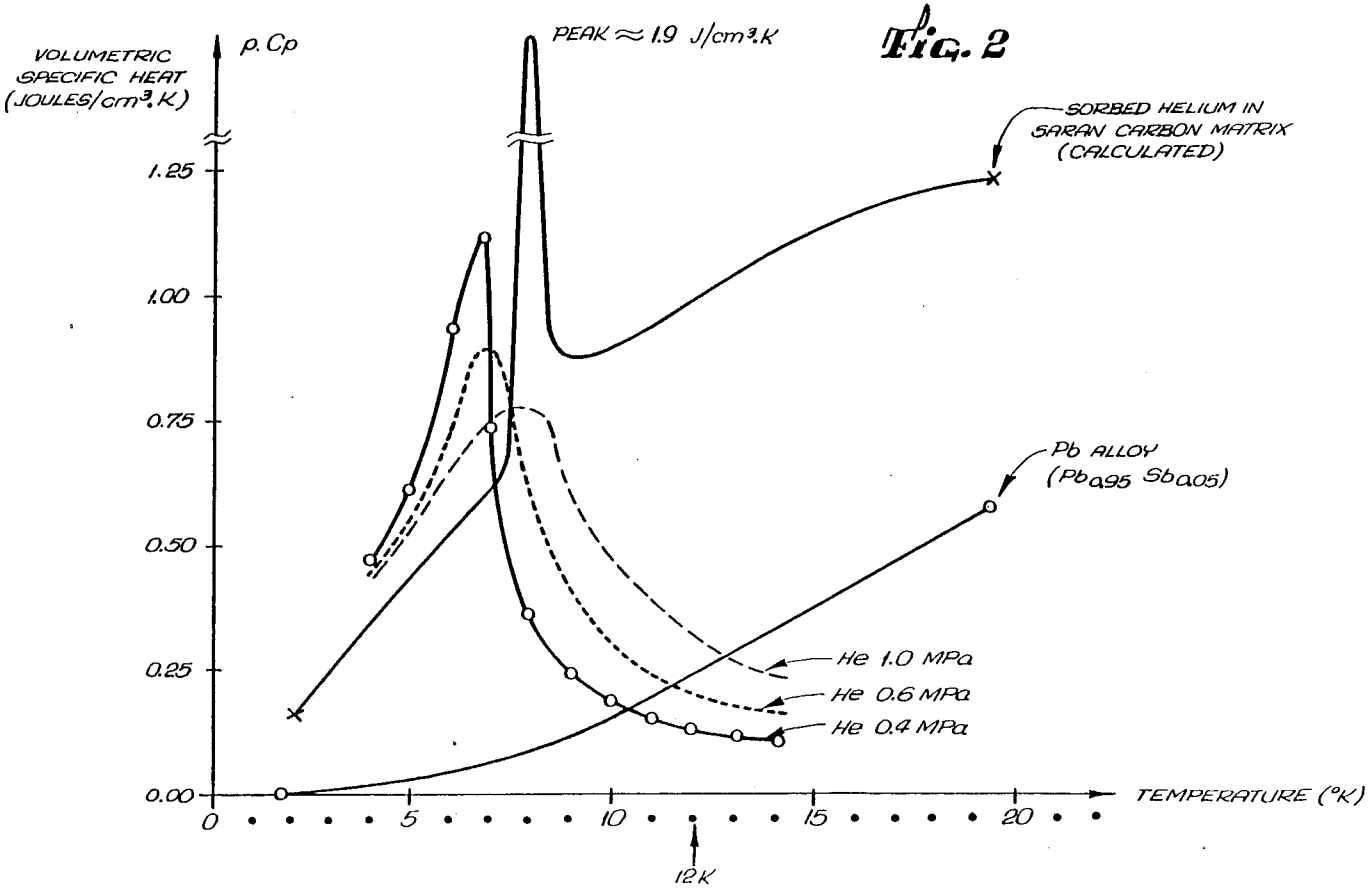
FIG. 2 is a graph of the volumetric specific heats of various helium refrigerants at temperatures around 10 K., the volumetric specific heat of Pb, and the volumetric specific heat of a regenerator including a mass of helium distributed in a matrix of saran charcoal.

FIG. 2 is a graph plotting the volumetric specific heat (VSH=heat capacity divided by volume) of lead (Pb) against that of helium adsorbed to saran charcoal and refrigerants (He 0.4 MPa–1.0 MPa) in the temperature range of 0 K.–20 K. Although heat capacity is a product of volume and volumetric specific heat, the operating capacity of a regenerator cannot be increased merely by increasing volume, other constraints including the heat conduction characteristics of a regenerator and its weight have to be considered. Lead based regenerators are known to operate very inefficiently at temperatures lower than 12 K.

It has been calculated that with a minimal adsorption and/or absorption of 15% helium by weight in a saran carbon type material having a density of 1.12 gm/cc, that the volumetric specific heat of a regenerator including such a helium sorbed saran carbon matrix will be roughly equal to or greater than 1 J/cc.K. at 12 K. That figure is about four times the volumetric specific heat of lead (Pb) at the same temperature. The term "sorbed" is used herein in a general sense to specify both adsorbed helium which is directly adhered to the surface of the carbon matrix and also helium which is contained within or absorbed into the pores of the material. The specific heat of a sorbed mass of helium has been measured by others to be approximately 6 J/gmK. at 12 K. The volumetric specific heat, $/c_{p(saran)}$ of a saran carbon regenerator at 12 K. is predicted to be approximately:

$$/c_{p(saran)} \geqq 0.15 \text{ gm He}/1.00 \text{ gm } C_{saran} \times 1.12 \text{ gm/cc} \times 6 \text{ J/gmK.} = 1.008 \text{ J/cc.K.}$$

The actual sorbed helium specific heat varies with temperature. A complete plot of the expected VSH for a helium sorbed saran D carbon is shown in FIG. 2. A phase transition peak of approximately 1.9 J/cc.K. or greater is predicted to occur around 8 K. as shown. The curve data is derived from measurements taken by Ray Radebaugh at the National Bureau of Standards in Boulder, Colo. on beads of Barnebey Cheney Charcoal having diameters less than 1 mm and a packing density less than approximately 0.4 times the density of the continous saran carbon (saran carbon D).

It will be noted from FIG. 2 that helium alone has a VSH much higher than that of Pb at temperatures below 12 K. Helium does not conduct heat well and consequently does not function efficiently by itself as the heat storage/transference material of a cryogenic regenerator. Carbon alone, on the other hand, does not store heat well but does conduct heat energy at a faster rate than helium. Saran carbon can be used in conjunction with the relatively high VSH of sorbed helium to provide a continuous heat conduction matrix throughout at least a portion of the volume of a cryogenic regenerator to thereby create a regenerator material of heat storing/transferring characteristics superior to those of either lead or helium taken alone. It is predicted that a helium sorbed saran carbon regenerator can be efficiently employed with helium gas refrigerants operating in a wide range of pressures (i.e., 0.1 MPa–15 MPa), the 0.4–1.0 MPA range being preferred.

A method for making a saran carbon having a density of 1.12 gm/cc over distances larger than 1 mm is disclosed in a paper by D. F. Quinn, et al., entitled "Solid Adsorbents For Storage of CNG For Automotive Use—Saran Carbon" delivered at the Alternate Energy Conference of June 1985, Windsor, Canada. The disclosed method comprises the steps of compressing a saran polymer (poly vinylidene chloride) into a disk shape under a pressure of 15,000 psi and slowly heating the compressed material in a vacuum or a nitrogen atmosphere to 700° C. The polymer is dehydrohalogenated in this environment. The process is slow and may take as long as two weeks for completion. A disk shaped carbon material having a relatively large percentage of micropores by volume is the end product of this method. The material is relatively non-brittle so it can be worked with and can withstand some vibration without crumbling. Saran carbon can be molded into various shapes and sizes. It is anticipated that other methods for making saran-carbon types of material will soon be developed. Experiments are now being conducted to determine whether saran carbon like microstructures can be produced from other organic polymers in less time.

The saran carbon type of material should be distinguished from ordinary charcoal, which as mentioned above, has been tried by others as a heat absorbing material for cryogenic regenerators. It should be noted that those who have experimented with charcoal have found its brittleness to be a major problem and have discarded the material as being impractical for commerical use. Ordinary charcoal can be characterized as having a large number of irregularly-shaped granules with a relatively large void volume (33% or more of total volume). Ordinary charcoal is also characterized as having a relatively large volume of macropores (pores with 50 nm diameters or geater). Macropores have been estimated to occupy at least 20% or more of the total volume of an ordinary charcoal mass. Large gaps are believed to occur between the irregularly shaped surfaces of charcoal particles.

Saran carbon, on the other hand, may be characterized as being highly uniform and continuous, particularly when made in the form of the above described disks (saran D). Samples of saran carbons have been manufactured with macropore volumes of as little as 15.5%–5.3% of total volume and micropore (pore diameters equal to or less than approximately 2–3 nm) volumes of as high as 26.5–35.2% of total volume. The density of these saran carbons has been measured to be in the range of 0.53–1.25 gm/cc. Saran carbons can be manufactured to exhibit these characteristics continuously for linear distances of 0.5 cm or more in at least some if not all directions. A continuity of the saran carbon material over distances of 1.0 cm or greater is preferred and continuity over a distance of approximately 25 cm or greater is even more preferred. Steam activation can be used to reduce carbon density while raising micropore volume. If the heat conductivity/heat storage capacity of the material needs to be altered for a particular cryogenic application, then the density/micropore volume characteristics of the material can be tailored by using steam activation. Heat conductivity and heat capacity are, of course, both important when designing a cryogenic regenerator. Preferably, micropore volume should be maximized for pore diameters less than 3 nanometers but greater than 1 nanometer.

Figure 3:
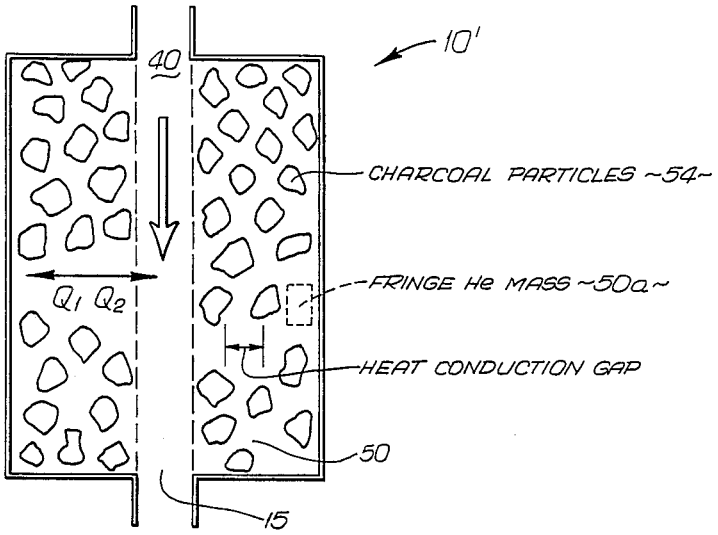
FIG. 3 PRIOR ART
FIG. 3 schematically illustrates a previously tried regenerator containing ordinary charcoal.
Figure 4:
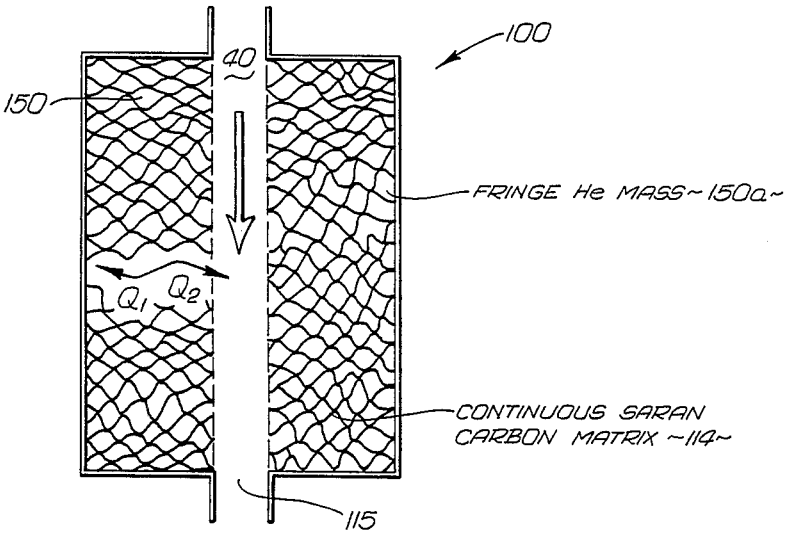
FIG. 4 schematically illustrates a regenerator containing saran carbon.

The relationship between heat conductivity, heat storage capacity, and regenerator efficiency can be appreciated by referring to FIGS. 3 and 4. FIG. 3 schematically diagrams a previously tried regenerator 10' which employed particles of ordinary charcoal 54 as its heat absorbing matrix. A heat storing mass of helium 50 is shown to fill spaces between the particles 54. FIG. 4 schematically diagrams a regenerator 100 in accordance with the present invention that uses a saran carbon body 114 having a helium mass 150 contained within its microporous matrix. The saran carbon matrix 114 transfers heat energy between the absorbed helium mass 150 and a flow-through gap 115.

When a refrigerant 40 passes through the gap region, 15 or 115, of a regenerator, 10 or 100, during a particular refrigeration cycle, there is usually a very short period of time for transferring heat energy, $Q_1$ or $Q_2$, between the heat storing mass of the regenerator and the refrigerant 40 flowing through that gap region, 15 or 115. The efficiency of a regenerator is therefore dependent not only on its heat storage capacity, but also on its rate of heat transfer. As stated earlier, helium has a relatively high volumetric specific heat but does not conduct heat quickly enough to be of practical use in most refrigeration systems. Heat can be conducted at a faster rate through carbon however, especially if the helium is adsorbed on the carbon surface to form a composite solid of carbon and helium. The effectiveness of such increased heat conductivity is dependent on the continuity of the carbon throughout the regenerator volume. Gaps within the carbon can significantly attenuate its effectiveness as a heat conductor. The mean distance separating individual atoms of the helium mass from the nearest portion of the carbon material is also an important factor.

Ordinary charcoal is formed of irregularly shaped granules which are separated by surface boundaries. Because of their irregular structure, a significant number of heat conduction gaps can develop between individual granules of the charcoal. When heat has to be transferred within a predetermined time frame, a fringe mass of helium **50*a* at the outer peripheries of a charcoal based regenerator 10' can be considered to be essentially decoupled from the flow-through gap region 15 because its heat energy will not couple to the flow-through gap 15 in time. Moreover, since ordinary charcoal usually contains a relatively large volume of macropores, the mean distance between a heat storing helium atom and the nearest heat conducting carbon atom can become significantly large. Distally located helium atoms, which cannot couple heat energy directly to the carbon material for transference to the flowing refrigerant 40** within the pre-set time limits of a refrigeration cycle, can be furthermore considered operationally non-functional as far as the heat regenerating capacity of a regenerator is concerned The macroporous structure of ordinary charcoal is consequently of little or no help in improving the heat capacity of a regenerator.

Referring to the continuous-matrix saran-carbon regenerator 100 shown in FIG. 4, it will be readily apparent that even fringe masses of helium **150*a* that are absorbed into the micropores of the saran-carbon body 114 distally located from a flow-through gap 115 can contribute effectively to the heat capacity of the regenerator 100. The saran-carbon matrix provides a continuous heat conducting mesh for transferring heat energy between atoms of helium 150 contained within the micropores and the flow-through gap region 115. Moreover, a relatively large surface area (1000 $m^2$/gm BET or better) is created by the micropores of the saran-carbon. This large surface area greatly enhances the rate of heat transfer between adsorbed portions of the helium mass 150 (portions adhereing to the walls of the micropores) and the saran carbon matrix 114. Furthermore, non-adsorbed portions of the helium mass 150 can contribute to the operational heat capacity of the regenerator 100** because of the short distance between the center of a micropore (diameters of 30 Angstroms or less) and the micropore walls.

FIGS. 5–7 illustrate a number of ways in which the distance between fringe portions of a heat storing mass (helium) in a regenerator and the flow-through gap can be minimized. A basically cylindrical shape is considered optimal for the overall structure of the regenerator. The cylindrical shape should be approximately 2–3 inches in height and have an outer diameter also of approximately 2–3 inches. The specific dimensions for optimizing regenerator performance depend on a variety of factors including the heat transfer time of the refrigeration cycle and the density of the regenerator material. In FIG. 5, one or more annularly shaped gaps 115' are defined between cylindrical and/or annularly shaped saran-carbon pieces 114'. The saran-carbon pieces 114' can be in direct contact with the gaps 115' or separated from the gaps 115' by enclosing the saran carbon pieces 114' in helium pressurized vessels of the same cyindrical/annular shape (not shown). The separate pieces 114' may be held in position by a conventional support structure (not shown). Since the wall area of an annular hollow is greater than that of a cylindrical hollow, heat transfer is increased by utilizing such structures. The saran carbon material is preferably made continuous in the radial direction from the inner gap wall, if any, to the outer diameter of its respective peice. Continuity should also be sought in the height direction of the cylinders in order to maximize the packing density of the saroan carbon material.

In FIG. 6, flow-through gaps 115'' are defined by planar slits cut through a cylindrical block of saran-carbon material 114''. In FIG. 7, a saran-carbon block 114''' is formed as a cylinder with a height H substantially smaller than its diameter D. The pores of the short cylindrical block 114''' form the flow-through gaps 115''' for the refrigerant 40.

Lead balls are likely to function better than saran carbon at higher temperatures. FIG. 8 shows a composite regenerator 200 in which an upper temperature portion is filled with a matrix of lead balls 14 and a lower temperature portion is filled with a saran-carbon material 114. Respective flow-through gaps 15 and 115 of the upper and lower portions are connected in tandem. This arrangement allows for the efficient use of both materials. The lead matrix 14 establishes a temperature gradient from an upper temperature $T_U$ down to an intermediate temperature $T_I$ of approximately 12 K. while the saran-carbon matrix 114 continues the temprature gradient from the intermediate temperature $T_I$ down to a substantially lower temperature $T_L$.

Numerous variations will become apparent to those skilled in the art once the spirit of the present invention is appreciated. Some of thse variations will result from routine design choice while others will be derived from a more detailed study of the disclosed invention. As such, the scope of the present invention should not be limited to the particular emobidments described herein but should rather be defined by the appended claims and equivalents thereof.

We claim:

1. A cryogenic regenerator comprising:

a first port for allowing a fluid to be cooled to flow therethrough;

a second port, displaced from the first port, for allowing the fluid to be cooled to flow therethrough;

a first heat storage matrix which includes a monolithic adsorbent material;

a fluid flow pathway coupling the first and second ports; and means, displaced along at least a portion of the fluid flow pathway, for thermally coupling the first heat storage matrix and the fluid to be cooled.

2. A cryogenic regenerator according to claim 1 wherein the first heat storage matrix further includes a heat storing mass of helium.

3. A cryogenic regenerator according to claim 1 wherein the monolithic adsorbent material is continuous over a linear distance of at least 0.5 cm.

4. A cryogenic regenerator according to claim 1 wherein the monolithic adsorbent material is saran carbon of the Dacey type and includes a substantial number of micropores having diameters less than 3 nanometers but greater than 1 nanometer.

5. A cryogenic regenerator according to claim 1, wherein the monolithic adsorbent material is substantially composed of carbon, the heat conductive matrix having a BET surface-area/mass ratio of approximately 1000 meters$^2$/gram or higher and a volumetric density of approximately 0.5 gm/cc or higher.

6. A cryogenic regenerator according to claim 1 wherein the monolithic adsorbent material is the product of heating a compressed body of polyvinylidene chloride to approximately 700° C. in a dehydrohalogenating environment.

7. A cryogenic regenerator according to claim 1 wherein the monolithic adsorbent material comprises a porous body of carbon wherein the porous carbon body has defined therein micropores of approximately 2 nanometer diameters or less occupying at least 20% of the carbon body volume.

8. A cryogenic refrigeration system according to claim 1, wherein the monolithic adsorbent material is saran carbon.

9. A cryogenic regenerator according to claim 1 wherein the first heat storage matrix is located near a lower temperature end of the regenerator and the regenerator further comprises a second heat storage matrix, located near an upper temperature end thereof.

10. A cryogenic refrigeration system according to claim 9, wherein the second heat storage matrix is made of a different material from said first heat storage matrix.

11. The regenerator of claim 1 wherein the first heat storage matrix has a basically cylindrical shape.

12. The regenerator of claim 11 wherein the means for thermally coupling comprises longitudinal slits provided through the cylindrical shape of the first heat storage matrix.

13. The regenerator of claim 11 wherein the means for thermally coupling comprises a cylindrically shaped hollow defined through a first heat storage matrix.

14. A cryogenic refrigeration system comprising:

compression means for compressing a cryogenic refrigerant;

a regenerative loop;

displacer means, coupled to the compression means and the regenerative loop, for moving the refrigerant through the regenerative loop; and regenerator means, coupled to the displacer means and the regenerative loop, for storing heat energy in a heat storing mass, the regenerator means including a heat transfer matrix for transferring heat energy between the heat storing mass and the refrigerant when the refrigerant moves through the regenerative loop, wherein the heat transfer matrix includes monolithic saran carbon.

15. A cryogenic refrigeration system according to claim 14 wherein at least a portion of the heat storing mass is absorbed in the saran carbon.

16. A cryogenic refrigeration system according to claim 15 wherein the heat storing mass includes helium.

* * * * *